US012760626B1

(12) United States Patent
Cruz et al.

(10) Patent No.: US 12,760,626 B1
(45) Date of Patent: Oct. 13, 2026

(54) SETTING A LINER HANGER

(71) Applicant: Saudi Arabian Oil Company, Dhahran (SA)

(72) Inventors: Raul Alfredo Garrido Cruz, Dhahran (SA); Kenechukwu O. Ufondu, Dhahran (SA); Saud Abdulaziz Shaheen, Jeddah (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 19/257,796

(22) Filed: Jul. 2, 2025

(51) Int. Cl.
*E21B 43/10* (2006.01)
*E21B 29/10* (2006.01)
*E21B 34/04* (2006.01)

(52) U.S. Cl.
CPC ..... *E21B 43/10* (2013.01); *E21B 29/10* (2013.01); *E21B 34/04* (2013.01)

(58) Field of Classification Search
CPC ..... E21B 23/06; E21B 23/042; E21B 29/10; E21B 37/04; E21B 37/02; E21B 43/10
See application file for complete search history.

(56) References Cited

U.S. PATENT DOCUMENTS 6,758,275 B2 * 7/2004 Martin ..... E21B 29/10 166/174
7,096,950 B2 * 8/2006 Howlett ..... E21B 29/002 166/99
7,559,374 B2 * 7/2009 Telfer ..... E21B 43/10 166/173
7,950,450 B2 * 5/2011 Martin ..... E21B 37/04 166/170
8,528,630 B2 9/2013 Tunget
9,428,998 B2 8/2016 Turley et al.
9,435,176 B2 * 9/2016 Bansal ..... E21B 37/02
9,879,505 B2 * 1/2018 Holloway ..... E21B 33/12
9,988,878 B2 * 6/2018 Ali ..... E21B 33/12
10,808,508 B2 10/2020 Giroux et al.
10,961,809 B2 * 3/2021 Sehsah ..... E21B 33/129
11,560,772 B2 * 1/2023 Stautzenberger ..... E21B 47/005
11,885,203 B1 * 1/2024 Greci ..... E21B 37/04
12,188,332 B1 * 1/2025 Kaltveit ..... E21B 37/00
2004/0011528 A1 * 1/2004 Howlett ..... E21B 37/02 166/173
2004/0031613 A1 * 2/2004 Martin ..... E21B 29/10 166/217
2005/0022995 A1 * 2/2005 Martin ..... E21B 37/04 166/174
2007/0039737 A1 * 2/2007 Telfer ..... E21B 37/02 166/173
2009/0025927 A1 * 1/2009 Telfer ..... E21B 37/04 166/174
2014/0116712 A1 * 5/2014 Bansal ..... E21B 37/02 166/170
2016/0305219 A1 * 10/2016 Holloway ..... E21B 33/12
(Continued)

FOREIGN PATENT DOCUMENTS

CN 120331716 A * 7/2025 ..... E21B 47/002
GB 2433079 A * 6/2007 ..... E21B 43/10

*Primary Examiner* — Jennifer H Gay
(74) *Attorney, Agent, or Firm* — Fish & Richardson P.C.

(57) ABSTRACT

A method includes setting, with a wellbore tool, a wellbore component in a wellbore. The method also includes conditioning, with the wellbore tool, a bore of the wellbore component by bearing against the bore of the wellbore component.

19 Claims, 5 Drawing Sheets

(56) References Cited

U.S. PATENT DOCUMENTS

| | | | | |
|---|---|---|---|---|
| 2016/0312582 | A1* | 10/2016 | Ali | E21B 37/02 |
| 2019/0284905 | A1* | 9/2019 | Sehsah | E21B 33/12 |
| 2020/0115995 | A1* | 4/2020 | Stautzenberger | E21B 47/005 |
| 2023/0021731 | A1* | 1/2023 | Hanson | E21B 37/02 |
| 2024/0035359 | A1* | 2/2024 | Greci | E21B 37/04 |

* cited by examiner

SETTING A LINER HANGER

TECHNICAL FIELD

This disclosure relates to wellbore running tools, in particular, to running tools for setting liner hangers.

BACKGROUND

Wellbores are typically constructed and prepared for production by disposing casing pipe into the wellbore and cementing the casing into place. A liner is a section of casing that does not extend to the top of the wellbore. The liner can be used to cement or otherwise isolate a portion of the wellbore. Liner assemblies often have polished bore receptacles to allow the liner to connect to different tools. Methods and equipment for improving the setting of liners are sought.

SUMMARY

Implementations of the present disclosure include a method that includes setting, with a wellbore tool, a wellbore component in a wellbore, and conditioning, with the wellbore tool, a bore of the wellbore component by bearing against the bore of the wellbore component.

In some implementations, the setting includes setting a packer of the wellbore component. In some implementations, setting the packer of the wellbore component includes running, with the wellbore tool, the wellbore component to a downhole location of the wellbore and setting, with the wellbore tool, the packer of the wellbore component at the downhole location.

In some implementations, the method further includes, before the conditioning, expanding one or more conditioning pads of the wellbore tool, and the conditioning includes bearing, with the one or more conditioning pads, against the bore of the wellbore component. In some implementations, the expanding includes activating, as a function of pressure pulses sensed by the wellbore tool, an actuator configured to expand the one or more conditioning pads. In some implementations, the actuator is a linear actuator, and activating the linear actuator includes extending a piston of the linear actuator to push a fluid to expand, with the fluid, the one or more conditioning pads. In some implementations, the bearing includes polishing, with the one or more conditioning pads, the bore of the wellbore component as the wellbore tool is rotated.

In some implementations, the wellbore tool is a running tool, the wellbore component includes a liner assembly including a liner hanger and a polished bore receptacle, and the bore of the wellbore component includes a bore of the polished bore receptacle, and the conditioning includes polishing, with the running tool, bore of the polished bore receptacle.

In some implementations, the conditioning includes conditioning, in a same trip as the setting, the bore of the wellbore component.

Implementations of the present disclosure also include a wellbore assembly that includes a wellbore string and a wellbore tool. The wellbore string is disposed within a wellbore. The wellbore tool is coupled with the wellbore string. The wellbore tool includes one or more conditioning pads. The wellbore tool is arranged to (i) set a wellbore component in the wellbore, and (ii) condition, with the wellbore component set in the wellbore, a bore of the wellbore component by bearing, with the one or more conditioning pads, against the bore of the wellbore component.

In some implementations, the wellbore tool is arranged run the wellbore component within the wellbore and set a packer of the wellbore component on a wall of the wellbore.

In some implementations, the one or more conditioning pads are movable between a retracted position and an extended position, the wellbore tool arranged to set, with the one or more conditioning pads in the retracted position, the wellbore component, and the wellbore tool arranged to condition, with the one or more conditioning pads in the extended position, the bore of the wellbore component.

In some implementations, the wellbore tool is arranged to condition the bore of the wellbore component by bearing, with the one or more conditioning pads, against the bore of the wellbore component as the wellbore tool is rotated.

In some implementations, the wellbore tool includes one or more sensors, a controller, and an actuator. The controller performs operations that include receiving, from the one or more sensors, sensor feedback, determining, as a function of the sensor feedback, that the sensor feedback satisfies a threshold, and controlling, as a function of the determination, one or more parameters of the actuator to expand the one or more conditioning pads to allow the wellbore tool to condition, with the one or more conditioning pads, a bore of the wellbore component.

In some implementations, the sensor feedback represents pressure pulses from surface fluid and the threshold includes a predetermined pattern of pressure pulses.

In some implementations, the actuator is a linear actuator arranged to expand a piston of the linear actuator to push a fluid to expand, with the fluid, the one or more conditioning pads.

In some implementations, the wellbore tool is a running tool, the wellbore component includes a liner assembly including a liner hanger and a polished bore receptacle, and the bore of the wellbore component includes a bore of the polished bore receptacle, and the conditioning includes polishing, with the running tool, the bore of the polished bore receptacle.

Implementations of the present disclosure include a running tool controller that includes one or more hardware processors and a computer storage medium communicatively coupled to the one or more hardware processors. The computer storage medium includes instructions that, when executed by the one or more hardware processors, cause the one or more hardware processors to perform operations including: receive, from one or more sensors of a wellbore tool, sensor feedback, determine, as a function of the sensor feedback, that the sensor feedback satisfies a threshold, and control, as a function of the determination, one or more parameters of a conditioning assembly to expand one or more conditioning pads of the conditioning assembly to allow the wellbore tool to condition, with the one or more conditioning pads and after setting a wellbore component in a wellbore, a bore of the wellbore component.

In some implementations, controlling the one or more parameters includes activating a linear actuator, and activating the linear actuator includes extending a piston of the linear actuator to push a fluid to expand, with the fluid, the one or more conditioning pads.

In some implementations, the sensor feedback represents pressure pulses from surface fluid and the threshold includes a predetermined pattern of pressure pulses.

Particular implementations of the subject matter described in this specification can be implemented so as to realize one or more of the following advantages. For example, the running tool of the present disclosure enables single trip setting and conditioning of a polished bore receptacle, eliminating the need for a separate run. This can save time and resources. Moreover, the running tool can be used in various well types, including onshore wells, offshore wells, conventional wells, unconventional wells, and different geological formations, streamlining the well completion process. Moreover, reducing the number of trips can help reducing the risk of accidents and environmental concerns associated with increased rig activity.

DETAILED DESCRIPTION OF THE DISCLOSURE

The present disclosure describes a liner hanger running tool that can set the liner hanger and conditioning the polished bore receptacle (PBR) of the liner hanger in a single trip. For example, the running tool can be used whenever a dedicated polish run is required. For example, the PBR can be conditioned immediately after cementing the liner and setting the liner's top packer. The running tool includes a polishing component that can be actuated from the surface. For example, the polishing component can be actuated through a predefined pressure sequence sensed by one or more sensors of the running tool. The running tool enables single-trip conditioning of the PBR (e.g., the conditioning can be done in the same trip as the setting of the liner hanger), eliminating the need for a separate run. The running tool is suitable for various well types, including onshore/offshore, conventional/unconventional, and different geological formations, streamlining the well completion process.

Figure 1:
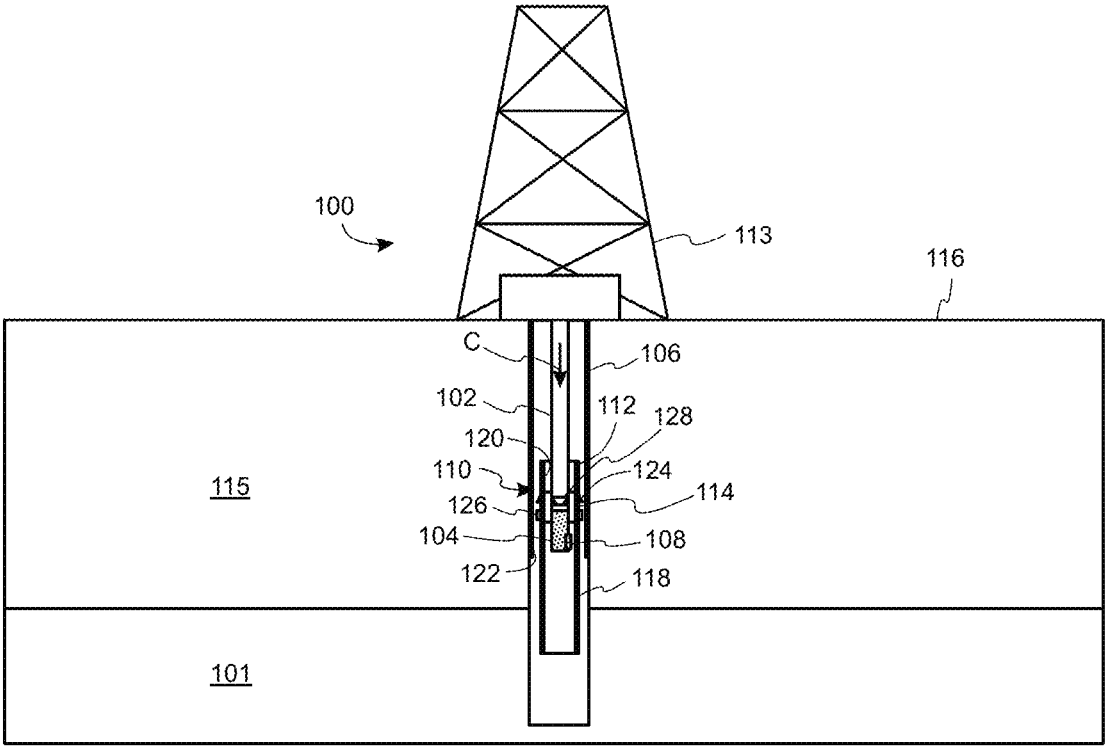
FIG. 1 is a front schematic view, partially cross-sectional, of an example wellbore assembly according to an implementation of the present disclosure.

FIG. 1 shows a front schematic view of a wellbore assembly 100 that includes a wellbore string 102 (e.g., a work string, a tool string, a running string, etc.) and a wellbore tool 104 (e.g., a running tool, a running sub, a setting sub, a conditioning sub, etc.) coupled with the wellbore string 102. The wellbore string 102 extends from surface equipment 113 (e.g., a rig) into a wellbore 106. The wellbore 106 extends through a subterranean zone 105 that includes a geologic formation 101. For example, the wellbore 106 extends down from a surface 116 (e.g., a terranean surface) of the wellbore 106 and is formed in the geologic formation 101. The geologic formation 101 includes a hydrocarbon reservoir from which hydrocarbons can be extracted.

The wellbore tool 104 has one or more conditioning pads that move from a retracted position to an expanded or extended position. The wellbore tool 104 both sets a wellbore component 110 in the wellbore, and conditions the wellbore component 110. For example, the wellbore tool 104 conditions a bore 120 of the wellbore component by bearing, with a conditioning pad 108, against the bore 120 of the wellbore component 110 as the wellbore tool 104 is rotated from the surface 116 (e.g., by the rig 113).

In some aspects, the wellbore component 110 is a liner assembly 110. In some aspects, the wellbore component can be another type of component such as a packer, a casing wall, a shoe track, etc., and the wellbore tool 104 can both set and condition (e.g., polish) the wellbore component. The wellbore tool sets the wellbore component at a downhole location of the wellbore (e.g., at or near a casing shoe of the wellbore casing). The liner assembly 110 includes a liner hanger 114, a polished bore receptacle 112 attached to the liner hanger 114, and a liner 118. The liner hanger 114 can include slips 124 and a packer 126. In some aspects, the liner assembly 110 includes other components such as a cementing sub, packers, slips, etc.

The wellbore tool 104 runs the liner assembly 110 within the wellbore 106, cements (if required) the liner 118 in place, and sets the packer 126 (and slips if applicable) of the liner hanger 114 on a wall 122 of the wellbore 106. The wellbore tool 104 sets, with the conditioning pad 108 in the retracted position, the liner hanger. After setting the liner hanger 114 (and, if applicable, after cementing the liner 118), the wellbore tool 104 expands its conditioning tool 108 and polishes the polished bore receptacle 112 to condition it for use (e.g., for receiving a seal assembly or a tieback packer).

The wellbore tool 104 can set the packer 126 and slips 124 mechanically, electrically, or hydraulically (e.g., using any mechanism of traditional liner hanger running tools). For example, the packer 126 can be set under fluid pressure that is applied by the wellbore string 102 after dropping a ball on a ball seat 128 to block a fluid pathway of the wellbore string 102. In some aspects, the packer 126 can be set mechanically (e.g., by tubing rotation or upward and downward movement, or under string weight applied by the wellbore string 102).

The wellbore string 102 is releasably coupled with the liner hanger 114. For example, the wellbore string 102 is attached to the liner hanger 114 with an internal latch system that includes shear fasteners. After running the assembly to depth and setting the liner hanger 114, the wellbore string 102 can be separated from the liner hanger 114 by shearing the fasteners hydraulically or mechanically by rotating the string a pre-determined number of turns to shear the fasteners.

After setting the liner hanger 114 in the casing of the wellbore 106, the wellbore string 102 can flow cement "C" from the surface 116 of the wellbore to a fluid outlet of the wellbore string 102 that is in fluid communication with the liner 118. The cement "C" flows, for example, from the wellbore string 102 to the liner 118 and out of the liner 118 to an open hole annulus of the wellbore 106 defined between an external wall of the liner 118 and a wall of the wellbore 106. After the cementing (and flush if applicable) process is completed, the liner assembly 110 is set in place and ready for the conditioning step. In some aspects, the wellbore tool 104 has a bore that extends through all or part of the length of the wellbore tool 104 to allow cement, mud, and other fluids to flow during the cementing operation.

Figure 2:
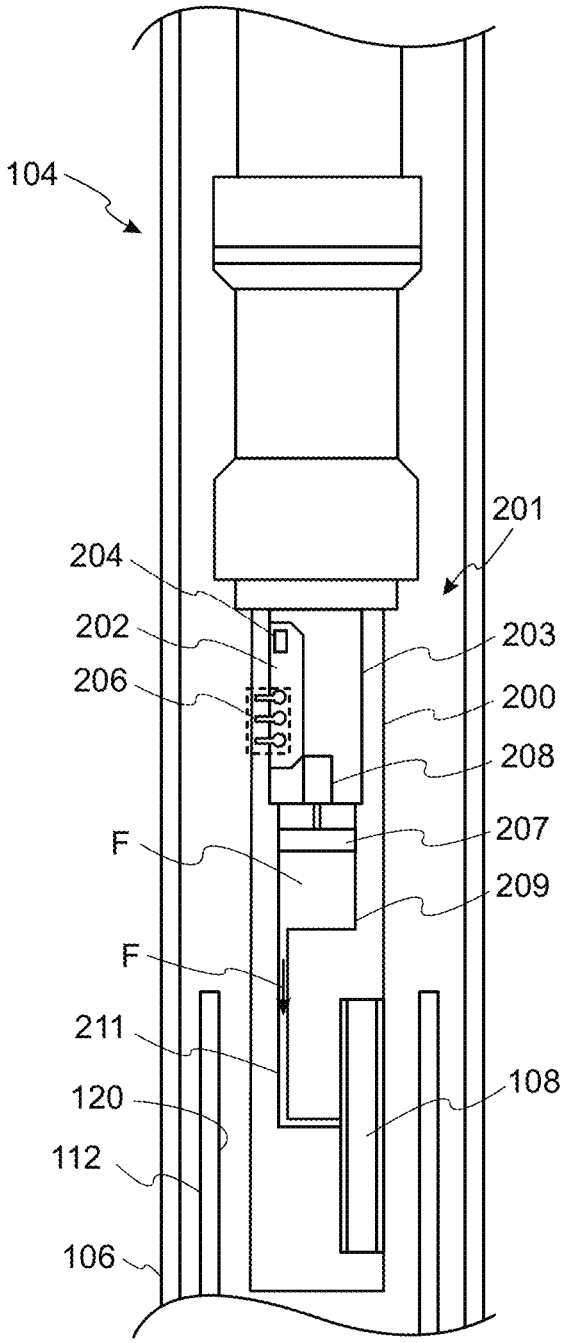
FIG. 2 is a front schematic view, partially cross-sectional, of an example wellbore tool according to an implementation of the present disclosure, with a conditioning pad retracted.
Figure 3:
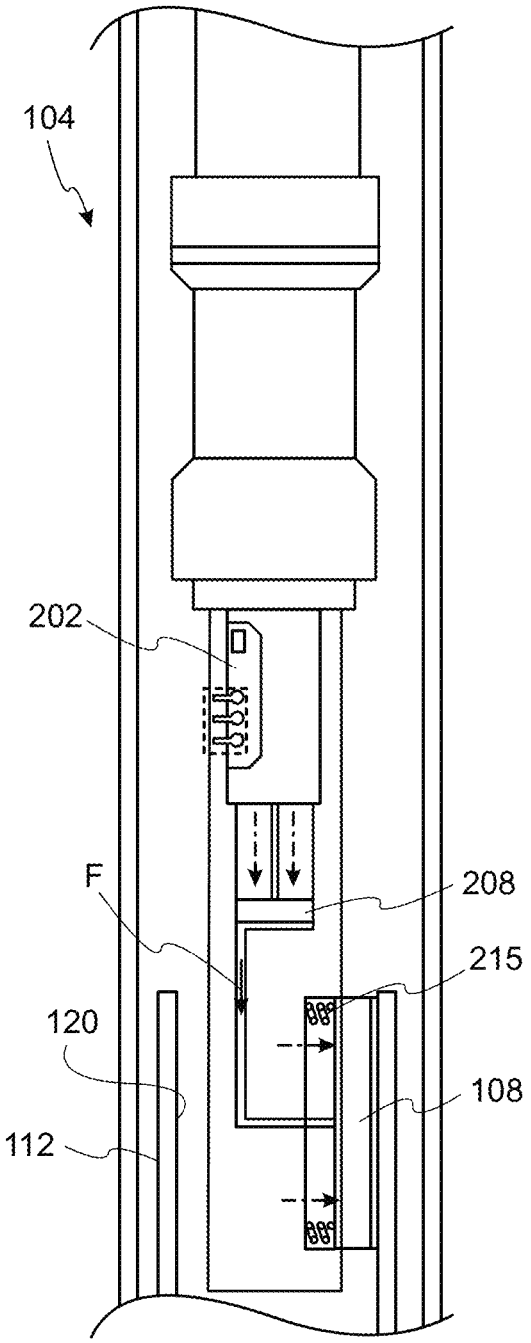
FIG. 3 is a front schematic view, partially cross-sectional, of an example wellbore tool according to an implementation of the present disclosure, with a conditioning pad expanded.

As illustrated in FIGS. 2 and 3, the conditioning pad 108 is movable between a retracted position (shown in FIG. 2)

and an extended position (shown in FIG. 3). FIG. 2 depicts the wellbore tool 104 disengaged from the liner hanger and movable with respect to the polished bore receptacle 112. As shown, the wellbore tool 104 has a conditioning assembly 201 that includes a controller 202 and the conditioning pad 108. In some aspects, the conditioning assembly 201 includes multiple conditioning pads 108 that are movable to condition the bore 120 of the polished bore receptacle 112. The conditioning assembly 201 uses the controller 202 to control an actuation mechanism to extend the conditioning pads 108. In some aspects, the controller receives electrical signals from the surface (e.g., through a cable or wirelessly), mud pulse signals (e.g., via a telemetry system), or another type of signals or information to control the conditioning pad 108. In some aspects, the controller 202 can control the actuation mechanism to retract the conditioning pads 108.

For example, the conditioning assembly 201 also includes sensors 206 (e.g., battery-powered, dual-channel pressure sensors), a battery 204 (e.g., battery pack) to power the electronic components (e.g., the sensors, the controller, and the actuator) of the conditioning assembly 201, an actuator 208 (e.g., a linear actuator), and a fluid "F" (e.g., a hydraulic fluid) that together work with the controller 202 to expand the conditioning pad 108. The conditioning assembly resides within a sub 200 of the wellbore tool 104. The controller 202 resides within a housing 203 of the sub 200. The actuator 208 can also reside within the housing 203. The sub 200 has a fluid chamber 209 and a fluid conduit 211 through which the fluid "F" moves to push the conditioning pad 108 from its retracted position to its extended position.

In some aspects, the controller 202 includes a telemetry system (e.g., a reverse mud pulse telemetry system) to receive instructions via pressure pulses, and the controller 202 can activate the actuator 208 to move the conditioning pad 108 based on those instructions. For example, the sensors 206 sense pressure pulses received through a water column (e.g., fluid flowed into the wellbore from the surface). For example, a mud pulse telemetry signal can be sent from the surface by one or more surface pumps through a fluid column to the sensors 206.

In some implementations, the controller 202 (e.g., running tool controller) can be implemented as one or more processors, computers, microcontrollers, or a combination thereof. For example, the controller 202 can include a telemetry system with sensors and instructions to receive and decode pressure pulses from the surface. The controller 202 can include one or more hardware processors and a computer-readable medium (e.g., computer storage medium) communicatively coupled with the processors and storing instructions executable by the one or more processors to perform the operations described here. In some implementations, the controller 202 can be implemented as processing circuitry, firmware, software, or combinations of them. The controller 202 can transmit signals and control the multiple components of the polishing assembly 201.

The controller 202 receives sensor feedback from the sensors 206. The sensor feedback can represent the pressure variations (e.g., pressure pulses) of the water column. The controller 202 then determines, as a function of the sensor feedback, whether the sensor feedback satisfies a threshold. For example, the threshold can represent a pressure sequence or pattern (e.g., predetermined pattern) that, when detected by the controller 202, triggers the controller 202 to activates the actuator. In some aspects, the threshold can be a pressure (or time lapse of a predetermined pressure) that triggers the controller to begin the process of detecting whether the following pressure pattern or sequence satisfies a predetermined pressure pattern or sequence. In some aspects, the conditioning pad 108 is positioned across or adjacent the polished bore receptacle before beginning the activation process of the pad 108.

Once the controller 202 determines that the pressure pulses satisfy a predefined pressure sequence, the controller 202 controls one or more parameters of the actuator 208 to expand the conditioning pad 108. For example, the controller 202 activates the actuator 208 as a function of determining that the detected pressure changes satisfy a predetermined pressure sequence. Once the actuator 208 is activated, the actuator extends a rod and/or piston 207 that pushes a fluid through the fluid conduit 211 to expand the conditioning pad 108. For instance, the piston 207 resides within fluid chamber 209 that contains hydraulic fluid "F." Upon activation, the piston 207 pushes the fluid "F" in the chamber 209 downhole toward the fluid conduit 211. As shown in FIG. 3, as the fluid flows downhole along the fluid conduit 211, the fluid "F" reaches a back surface of the conditioning pad 108 and pushes, by filling a volume underneath conditioning pad 108, the conditioning pad 108 out of a cavity containing the conditioning pad 108. In some aspects, the pad 18 can be retractable. For example, the pad 108 can be spring-loaded (e.g., with tension springs 215) that bias the pad 108 into the cavity to retract the pad when the fluid is flowed back by the piston (e.g. as the piston retracts).

As shown in FIG. 3, with the conditioning pad 108 expanded, the wellbore tool 104 is able to polish the bore 120 of the polished bore receptacle 112 by bearing, with the conditioning pad 108, against the polished bore receptacle as the wellbore tool 104 (and by extension the pad) is rotated. The conditioning pad 108 can be or include, for example, an abrasive surface such as abrasive stones, sanding paper, sanding sponges, polishing mill, or any material or element that allows the polished bore receptacle to be honed, polished, sanded, and/or otherwise conditioned for use. The wool can have multiple conditioning pads, each with a different surface to perform different conditioning operations or to achieve different surface finishes.

Figure 4:
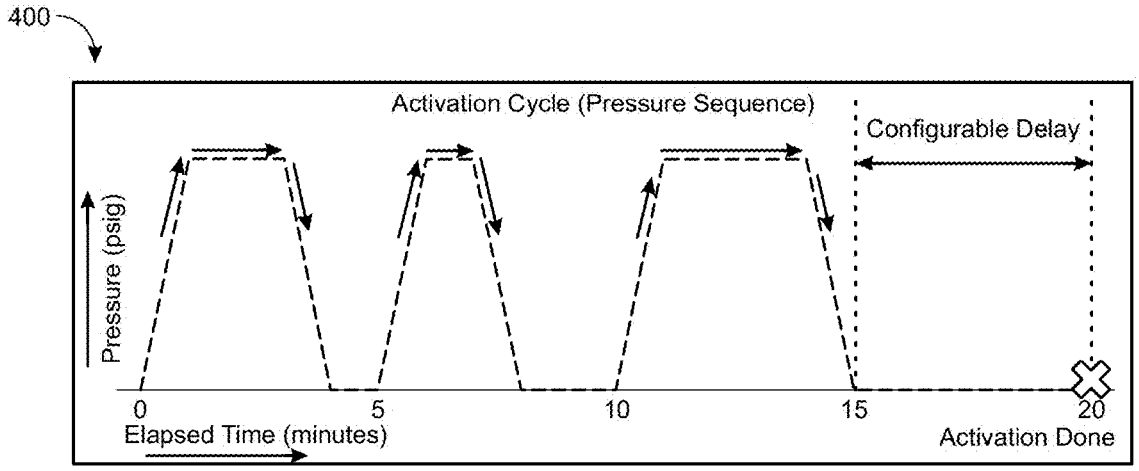
FIG. 4 is an example pressure vs. time plot showing an example activation pressure sequence.

FIG. 4 is an example pressure vs. time plot showing an example activation pressure sequence. The predefined pressure sequence can be applied to the well utilizing surface pumps. In the example shown, there are three pressure spikes/pulses in a span of 15 minutes, with the middle pressure spike having the least duration, and the last pressure spike having the longest duration (e.g., about 5 minutes). In some aspects, the pressure and duration values are configurable. For example, the time duration of each pressure spike, the time duration between pressure spikes, or the delay at the end of the pressure spikes can be configured to meet different conditions or processes.

Figure 5:
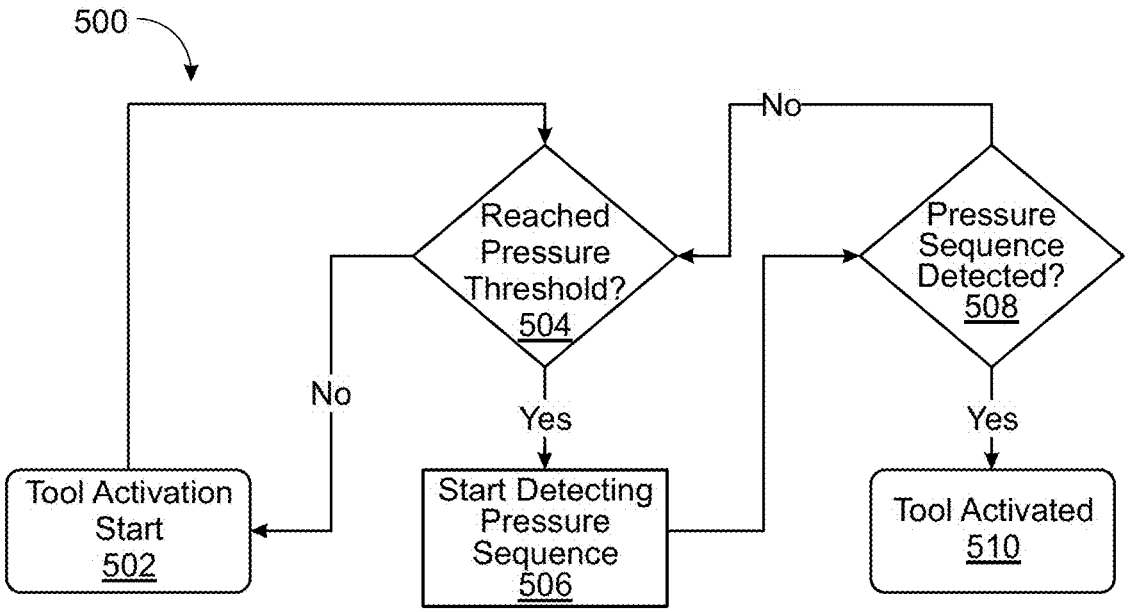
FIG. 5 is an example activation mechanism flow chart.

FIG. 5 is an example activation mechanism flow chart 500. The activation mechanism or process begins at a step represented by 502, where the tool activation starts. The tool activation can be started by starting to control the fluid pumps at surface. In the step represented by 504, the controller determines whether the pressure in the well reaches a pressure threshold. If not, the controller goes back to step 502 and continues to determine whether the pressure threshold is reached. If the pressure threshold is reached, the controller starts, in step 506, detecting the pressure sequence. In step 508, the controller determines whether the pressure sequence is detected. If the pressure sequence is not detected, the controller goes back to step 504 to continue to determine whether the pressure threshold is met. If the pressure sequence is detected, as represented by step 510, the controller activates the tool.

Figure 6:
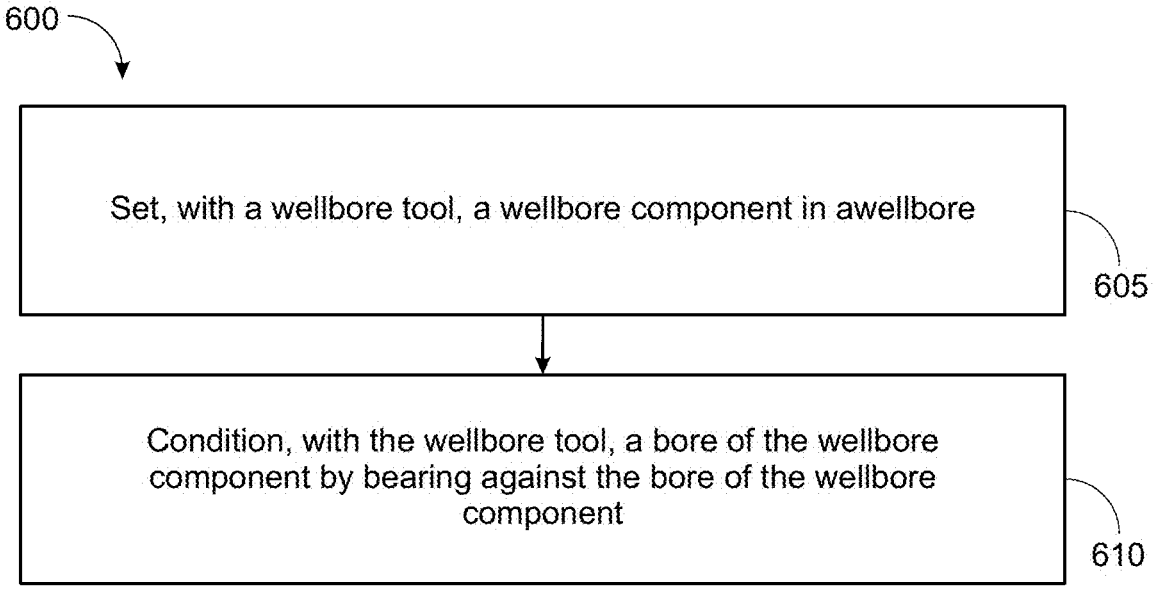
FIG. 6 is a flow chart of an example method of setting and conditioning a wellbore component.

FIG. 6 shows a flow chart of an example method (600) of setting and conditioning a wellbore component. The method includes (600) include setting, with a wellbore tool, a wellbore component in the wellbore (605). The method also includes conditioning, with the wellbore tool, a bore of the wellbore component by bearing against the bore of the wellbore component (610). As described above, the wellbore tool can be a running tool, the wellbore component can be a liner assembly that includes a liner hanger and a polished bore receptacle, and the bore of the wellbore component can be a bore of the polished bore receptacle.

Figure 7:
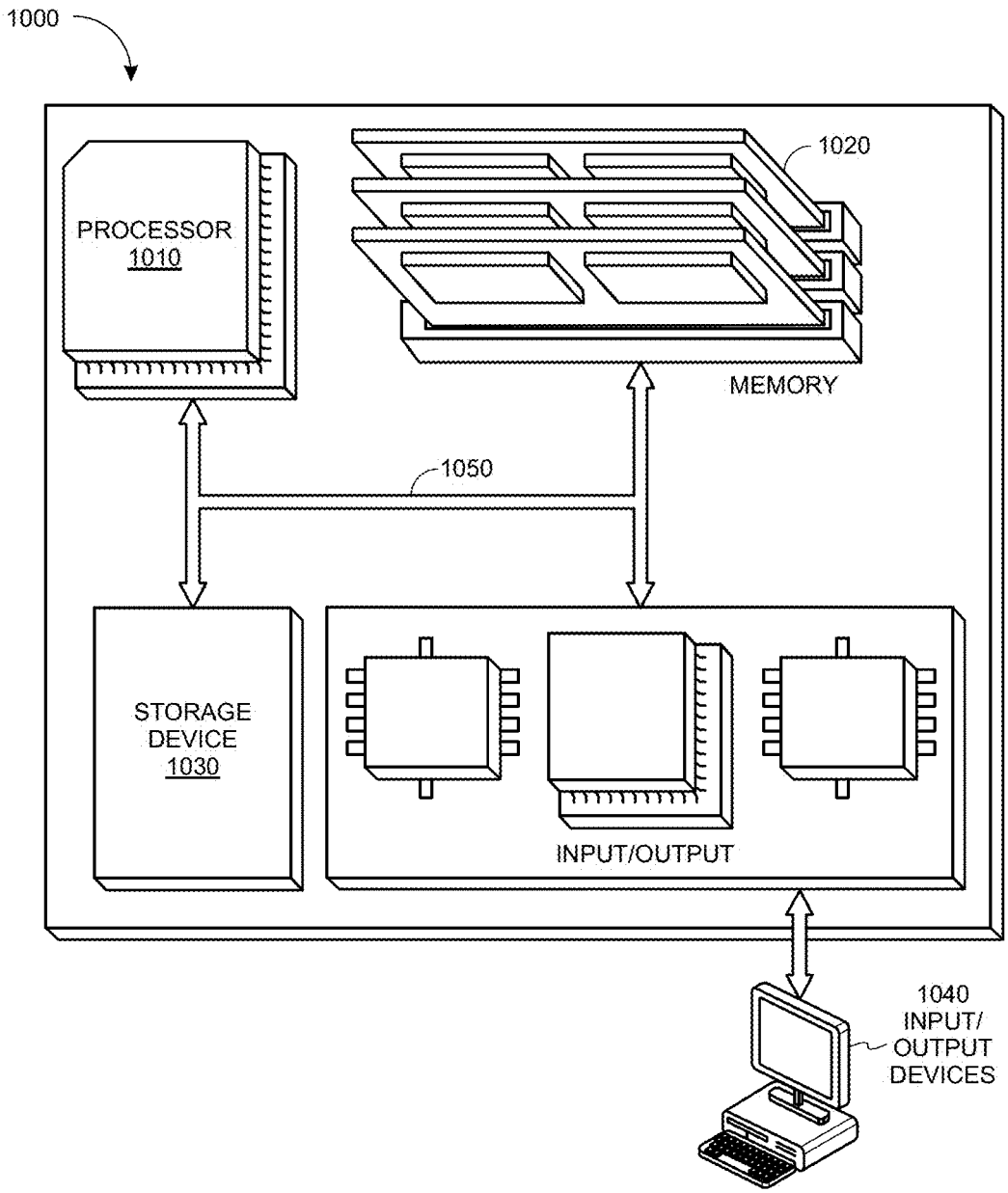
FIG. 7 is a schematic illustration of an example control system or controller for a running tool according to implementations of the present disclosure.

FIG. 7 is a schematic illustration of an example control system or controller for a wellbore tool according to the present disclosure. For example, the controller 1000 can include or be part of the controller 202 shown in FIGS. 2 and 3. The controller 1000 is intended to include various forms of digital computers, such as printed circuit boards (PCB), processors, digital circuitry, or otherwise. Additionally, the system can include portable storage media, such as, Universal Serial Bus (USB) flash drives. For example, the USB flash drives can store operating systems and other applications. The USB flash drives can include input/output components, such as a wireless transmitter or USB connector that can be inserted into a USB port of another computing device.

The controller 1000 includes a processor 1010, a memory 1020, a storage device 1030, and an input/output device 1040. Each of the components 1010, 1020, 1030, and 1040 are interconnected using a system bus 1050. The processor 1010 is capable of processing instructions for execution within the controller 1000. The processor can be designed using any of a number of architectures. For example, the processor 1010 can be a CISC (Complex Instruction Set Computers) processor, a RISC (Reduced Instruction Set Computer) processor, or a MISC (Minimal Instruction Set Computer) processor.

In one implementation, the processor 1010 is a single-threaded processor. In another implementation, the processor 1010 is a multi-threaded processor. The processor 1010 is capable of processing instructions stored in the memory 1020 or on the storage device 1030 to display graphical information for a user interface on the input/output device 1040.

The memory 1020 stores information within the controller 1000. In one implementation, the memory 1020 is a computer-readable medium. In one implementation, the memory 1020 is a volatile memory unit. In another implementation, the memory 1020 is a non-volatile memory unit.

The storage device 1030 is capable of providing mass storage for the controller 1000. In one implementation, the storage device 1030 is a computer-readable medium. In various different implementations, the storage device 1030 may be a floppy disk device, a hard disk device, an optical disk device, or a tape device.

The input/output device 1040 provides input/output operations for the controller 1000. In one implementation, the input/output device 1040 includes a keyboard and/or pointing device. In another implementation, the input/output device 1040 includes a display unit for displaying graphical user interfaces.

While this specification contains many specific implementation details, these should not be construed as limitations on the scope of any embodiments or of what may be claimed, but rather as descriptions of features specific to particular implementations of particular embodiments. Certain features that are described in this specification in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous.

A number of implementations have been described. Nevertheless, it will be understood that various modifications may be made without departing from the spirit and scope of the disclosure. For example, example operations, methods, or processes described herein may include more steps or fewer steps than those described. Further, the steps in such example operations, methods, or processes may be performed in different successions than that described or illustrated in the figures. Accordingly, other implementations are within the scope of the following claims.

EXAMPLES

In an example implementation, a method comprises: setting, with a wellbore tool, a wellbore component in a wellbore; and conditioning, with the wellbore tool, a bore of the wellbore component by bearing against the bore of the wellbore component.

In an example implementation combinable with any other example implementation, the setting comprises setting a packer of the wellbore component.

In an example implementation combinable with any other example implementation, setting the packer of the wellbore component comprises running, with the wellbore tool, the wellbore component to a downhole location of the wellbore and setting, with the wellbore tool, the packer of the wellbore component at the downhole location.

In an example implementation combinable with any other example implementation, the method further comprises, before the conditioning, expanding one or more conditioning pads of the wellbore tool, and wherein the conditioning comprises bearing, with the one or more conditioning pads, against the bore of the wellbore component.

In an example implementation combinable with any other example implementation, the expanding comprises activating, as a function of pressure pulses sensed by the wellbore tool, an actuator configured to expand the one or more conditioning pads.

In an example implementation combinable with any other example implementation, the actuator is a linear actuator, and activating the linear actuator comprises extending a piston of the linear actuator to push a fluid to expand, with the fluid, the one or more conditioning pads.

In an example implementation combinable with any other example implementation, the bearing comprises polishing, with the one or more conditioning pads, the bore of the wellbore component as the wellbore tool is rotated.

In an example implementation combinable with any other example implementation, the wellbore tool is a running tool, the wellbore component comprises a liner assembly comprising a liner hanger and a polished bore receptacle, and the bore of the wellbore component comprises a bore of the polished bore receptacle, and the conditioning comprises polishing, with the running tool, bore of the polished bore receptacle.

In an example implementation combinable with any other example implementation, the conditioning comprises conditioning, in a same trip as the setting, the bore of the wellbore component.

In another example implementation, the wellbore assembly includes a wellbore string disposed within a wellbore; and a wellbore tool coupled with the wellbore string, the wellbore tool comprising one or more conditioning pads; wherein the wellbore tool is arranged to (i) set a wellbore component in the wellbore, and (ii) condition, with the wellbore component set in the wellbore, a bore of the wellbore component by bearing, with the one or more conditioning pads, against the bore of the wellbore component.

In an example implementation combinable with any other example implementation, the wellbore tool is arranged run the wellbore component within the wellbore and set a packer of the wellbore component on a wall of the wellbore.

In an example implementation combinable with any other example implementation, the one or more conditioning pads are movable between a retracted position and an extended position, the wellbore tool arranged to set, with the one or more conditioning pads in the retracted position, the wellbore component, and the wellbore tool arranged to condition, with the one or more conditioning pads in the extended position, the bore of the wellbore component.

In an example implementation combinable with any other example implementation, the wellbore tool is arranged to condition the bore of the wellbore component by bearing, with the one or more conditioning pads, against the bore of the wellbore component as the wellbore tool is rotated.

In an example implementation combinable with any other example implementation, the wellbore tool comprises one or more sensors, a controller, and an actuator, the controller configured to perform operations comprising: receive, from the one or more sensors, sensor feedback; determine, as a function of the sensor feedback, that the sensor feedback satisfies a threshold; and control, as a function of the determination, one or more parameters of the actuator to expand the one or more conditioning pads to allow the wellbore tool to condition, with the one or more conditioning pads, a bore of the wellbore component.

In an example implementation combinable with any other example implementation, the sensor feedback represents pressure pulses from surface fluid and the threshold comprises a predetermined pattern of pressure pulses.

In an example implementation combinable with any other example implementation, the actuator is a linear actuator arranged to expand a piston of the linear actuator to push a fluid to expand, with the fluid, the one or more conditioning pads.

In an example implementation combinable with any other example implementation, the wellbore tool is a running tool, the wellbore component comprises a liner assembly comprising a liner hanger and a polished bore receptacle, and the bore of the wellbore component comprises a bore of the polished bore receptacle, and the conditioning comprises polishing, with the running tool, the bore of the polished bore receptacle.

In another example implementation, a running tool controller comprises one or more hardware processors; and a computer storage medium communicatively coupled to the one or more hardware processors, the computer storage medium comprising instructions that, when executed by the one or more hardware processors, cause the one or more hardware processors to perform operations comprising: receive, from one or more sensors of a wellbore tool, sensor feedback; determine, as a function of the sensor feedback, that the sensor feedback satisfies a threshold; and control, as a function of the determination, one or more parameters of a conditioning assembly to expand one or more conditioning pads of the conditioning assembly to allow the wellbore tool to condition, with the one or more conditioning pads and after setting a wellbore component in a wellbore, a bore of the wellbore component.

In an example implementation combinable with any other example implementation, controlling the one or more parameters comprises activating a linear actuator, and activating the linear actuator comprises extending a piston of the linear actuator to push a fluid to expand, with the fluid, the one or more conditioning pads.

In an example implementation combinable with any other example implementation, the sensor feedback represents pressure pulses from surface fluid and the threshold comprises a predetermined pattern of pressure pulses.

What is claimed is:

1. A method, comprising:

setting, with a wellbore tool, a wellbore component in a wellbore;

expanding one or more conditioning pads of the wellbore tool, the expanding comprising activating a linear actuator as a function of pressure pulses sensed by the wellbore tool to extend a piston of the linear actuator to push a fluid with the piston to fill a volume underneath the one or more conditioning pads with the fluid to extend, with the fluid pushing the one or more conditioning pads, the one or more conditioning pads out of a cavity that houses the one or more conditioning pads; and conditioning, with the one or more conditioning pads expanded, a bore of the wellbore component by bearing against the bore of the wellbore component with the one or more conditioning pads.

2. The method of claim 1, wherein the setting comprises setting a packer of the wellbore component.

3. The method of claim 2, wherein setting the packer of the wellbore component comprises running, with the wellbore tool, the wellbore component to a downhole location of the wellbore and setting, with the wellbore tool, the packer of the wellbore component at the downhole location.

4. The method of claim 1, wherein the bearing comprises polishing, with the one or more conditioning pads, the bore of the wellbore component as the wellbore tool is rotated.

5. The method of claim 1, wherein the wellbore tool is a running tool, the wellbore component comprises a liner assembly comprising a liner hanger and a polished bore receptacle, and the bore of the wellbore component comprises a bore of the polished bore receptacle, and the conditioning comprises polishing, with the running tool, bore of the polished bore receptacle.

6. The method of claim 1, wherein the conditioning comprises conditioning, in a same trip as the setting, the bore of the wellbore component.

7. The method of claim 1, wherein each of the one or more conditioning pads is spring-loaded with a tension spring arranged to bias the pad into the cavity to retract the pad into the cavity as the fluid is removed from the cavity, and the method further comprises retracting the one or more conditioning pads by removing fluid from the cavity.

8. The method of claim 1, further comprising cementing, in a same trip a the setting and conditioning, the wellbore component in the wellbore.

9. The method of claim 1, wherein the activating comprises:

determining that a pressure sensed by the wellbore tool satisfies a first threshold, detecting, as a function of the determination, a sequence of the pressure pulses, determining that the sequence satisfies a second threshold, and activating, as a function of determining that the sequence satisfies the second threshold, the linear actuator.

10. A wellbore assembly, comprising:

a wellbore string disposed within a wellbore; and a wellbore tool coupled with the wellbore string, the wellbore tool comprising one or more conditioning pads;

wherein the wellbore tool is arranged to:

set a wellbore component in the wellbore, expand the one or more conditioning pads of the wellbore tool, the expanding comprising activating, as a function of pressure pulses sensed by the wellbore tool, a linear actuator of the wellbore tool to extend a piston of the linear actuator to push a fluid with the piston to fill a volume underneath the one or more conditioning pads with the fluid to extend, with the fluid pushing the one or more conditioning pads, the one or more conditioning pads out of a cavity that houses the one or more conditioning pads, and condition, with the expanded one or more conditioning pads, a bore of the wellbore component by bearing, with the one or more conditioning pads, against the bore of the wellbore component.

11. The wellbore assembly of claim 10, wherein the wellbore tool is arranged run the wellbore component within the wellbore and set a packer of the wellbore component on a wall of the wellbore.

12. The wellbore assembly of claim 10, wherein the one or more conditioning pads are movable between a retracted position and an expanded position, the wellbore tool arranged to set, with the one or more conditioning pads in the retracted position, the wellbore component, and the wellbore tool arranged to condition, with the one or more conditioning pads in the expanded position, the bore of the wellbore component.

13. The wellbore assembly of claim 12, wherein the wellbore tool is arranged to condition the bore of the wellbore component by bearing, with the one or more conditioning pads, against the bore of the wellbore component as the wellbore tool is rotated.

14. The wellbore assembly of claim 12, wherein the wellbore tool comprises one or more sensors and a controller, the controller configured to perform operations comprising:

receive, from the one or more sensors, sensor feedback;

determine, as a function of the sensor feedback, that the sensor feedback satisfies a threshold; and control, as a function of the determination, one or more parameters of the actuator to expand the one or more conditioning pads to allow the wellbore tool to condition, with the one or more conditioning pads, a bore of the wellbore component.

15. The wellbore assembly of claim 14, wherein the sensor feedback represents pressure pulses from surface fluid and the threshold comprises a predetermined pattern of pressure pulses.

16. The wellbore assembly of claim 10, wherein the wellbore tool is a running tool, the wellbore component comprises a liner assembly comprising a liner hanger and a polished bore receptacle, and the bore of the wellbore component comprises a bore of the polished bore receptacle, and the conditioning comprises polishing, with the running tool, the bore of the polished bore receptacle.

17. The wellbore assembly of claim 10, wherein each of the one or more conditioning pads is spring-loaded with a tension spring arranged to bias the pad into the cavity to retract the pad into the cavity as the fluid is removed from the cavity.

18. A running tool controller, comprising:

one or more hardware processors; and a computer storage medium communicatively coupled to the one or more hardware processors, the computer storage medium comprising instructions that, when executed by the one or more hardware processors, cause the one or more hardware processors to perform operations comprising:

receive, from one or more sensors of a wellbore tool, sensor feedback;

determine, as a function of the sensor feedback, that the sensor feedback satisfies a threshold; and control, as a function of the determination, one or more parameters of a conditioning assembly to expand one or more conditioning pads of the conditioning assembly to allow the wellbore tool to condition, with the one or more conditioning pads and after setting a wellbore component in a wellbore, a bore of the wellbore component, the expanding comprising activating, as a function of pressure pulses sensed by the one or more sensors, a linear actuator to extend a piston of the linear actuator to push a fluid with the piston to fill a volume underneath the one or more conditioning pads with the fluid to extend, with the fluid pushing the one or more conditioning pads, the one or more conditioning pads out of a cavity that houses the one or more conditioning pads.

19. The running tool controller of claim 18, wherein the sensor feedback represents pressure pulses from surface fluid and the threshold comprises a predetermined pattern of pressure pulses.

* * * * *